United States Patent [19]

George et al.

[11] Patent Number: 4,650,010

[45] Date of Patent: Mar. 17, 1987

[54] BOREHOLE DEVICES ACTUATED BY FLUID PRESSURE

[75] Inventors: Flint R. George, Katy; Marlin R. Smith, Houston, both of Tex.

[73] Assignee: Halliburton Company, Duncan, Okla.

[21] Appl. No.: 675,113

[22] Filed: Nov. 27, 1984

[51] Int. Cl.[4] ..... E21B 43/11

[52] U.S. Cl. ..... 175/4.52; 166/55.1; 175/4.54; 175/4.56

[58] Field of Search ..... 166/297, 55.1, 55, 299, 166/63; 175/4.52, 4.54, 4.56; 102/322, 223, 230

[56] References Cited

U.S. PATENT DOCUMENTS

| | | | |
|---|---|---|---|
| 2,749,840 | 6/1956 | Babcock | 102/20 |
| 2,760,408 | 8/1956 | Taylor | 89/1 |
| 3,011,551 | 12/1961 | Young et al. | 166/55.1 |
| 3,040,808 | 6/1962 | Schramm et al. | 166/55.1 |
| 3,071,072 | 1/1963 | Castel et al. | 102/20 |
| 3,189,094 | 6/1965 | Hyde | 175/4.52 |
| 4,266,613 | 5/1981 | Boop | 166/299 |
| 4,361,188 | 11/1982 | Russell | 166/381 |
| 4,554,981 | 11/1985 | Davies | 175/4.52 |

FOREIGN PATENT DOCUMENTS 92476 10/1983 European Pat. Off. .

*Primary Examiner*—James A. Leppink
*Assistant Examiner*—Hoang C. Dang
*Attorney, Agent, or Firm*—James R. Duzan

[57] ABSTRACT

An apparatus for actuating a tool downhole in a borehole. The apparatus includes a body; a port to admit fluid pressure into the body; and apparatus within the body in fluid pressure communication with the port for actuating the tool in response to (1) a fluid pressure level communicated through the port in excess of a first fluid pressure level greater than the hydrostatic pressure level, followed by (2) a decrease in the fluid pressure level communicated through the port from the first fluid pressure level to a second fluid pressure level less than the first fluid pressure level.

13 Claims, 4 Drawing Figures

BOREHOLE DEVICES ACTUATED BY FLUID PRESSURE

BACKGROUND OF THE INVENTION

The present invention relates to devices operable by fluid pressure for use in boreholes, such as oil and/or gas wells.

It is often desireable to utilize fluid pressure as the means of actuating a tool downhole in a borehole. It is particularly advantageous to utilize such tools in offshore applications where it is diffucult to manipulate the tool string or tubing string in a well. In certain exemplary applications, explosive charges are utilized in boreholes to perform various functions, for example, to perforate a well casing to complete or test a formation, to sever tubing or to pulverize unretrievable junk. Due to the time and expense involved in these operations and the explosive power of these devices, it is essential that their operation be reliable. Traditional methods for actuating explosive devices downhole include dropping a detonating bar through tubing to impact a firing head, manipulation of the tubing string to activate explosives, and use of an electrical wireline to communicate an electrical signal to a firing device.

Often the borehole environment poses severe difficulties for the safe and effective use of these methods. For example, the presence of heavy drilling muds and debris can interfere with the proper operation of an impact responsive firing head since debris and particles from the drilling mud can settle out on the firing head preventing its operation. In deviated boreholes, detonating bars may stick before reaching bottom. In many applications it is not feasible to utilize an impact responsive firing head. In drill stem testing, a zone to be tested is perforated and various downhole parameters such as temperature and pressure are monitored by instruments mounted between the tubing and the firing head. These are often non-fullbore opening devices which do not permit a detonating bar to pass through to the firing head.

In permanent completion operations and drill stem testing operations, wireline systems do not provide the same high degree of control over the well that tubing conveyed systems provide. Since it is not known with certainty whether a substantial pressure differential or underbalance from the formation into the borehole exists prior to perforation, from time to time it happens that a wireline gun is forced violently from a borehole after detonation due to an unexpectedly high underbalance, thus causing considerable damage and posing a substantial safety hazard. Even where such hazards do not exist, the need to use a wireline to actuate the gun requires the manipulation of the wireline downwardly through the well.

Systems which involve mechanical manipulation of the tubing string are cumbersome and present the possibility that the explosives will be prematurely activated as the tubing string is being run into the hole. In addition, in offshore applications, it is desirable to dispense with the need for mechanical manipulation of the tubing string, especially when the work is being performed on a floating rig.

For the above reasons, among others, it is desirable in many instances to utilize fluid pressure responsive explosive firing devices. Such devices typically involve the elevation of pressure in the borehole to actuate the firing device. There are, however, numerous applications which call for the maintenance of a relatively low pressure at the time of explosive actuation, such as where it is desired to perforate with a pressure differential into the borehole, i.e. with an underbalance. This requirement may not be compatible, therefore, with the use of conventional pressure responsive firing devices operated by increasing pressure above the hydrostatic level.

U.S. Pat. No. 3,189,094 to Hyde shows a firing apparatus which is armed or prepared for operation by utilizing the submergence pressure exerted by the surrounding well fluid in which the gun perforator is lowered, and subsequently operates after the accompanying packer or packers are set and have established a relatively low pressure zone in the region to be gun peforated. In one such firing apparatus, submergence pressure is applied to one side of a piston through a fluid metering device and to the other side of the piston through an unmetered fluid passageway in communication with tubing pressure. After the packer has been set, a tester valve in the tubing string is opened which begins to reduce the fluid pressure level in the annulus below the packer. The rate of pressure decrease below the piston is much faster than that above the piston, since fluid pressure thereabove must flow through the metering device, so that a temporary pressure differential is produced, forcing the piston downwardly against a firing hammer to actuate a perforating gun. In another such device shown in the Hyde patent, annulus pressure is applied to an upper side of a piston through a fluid passageway extending through a packer which has been set to isolate a lower annulus in communication with the interior of the pipe string from the upper annulus. A lower side of the piston is exposed to tubing and lower annulus pressure, so that when the tester valve is opened, the differential pressure between the upper annulus and lower annulus causes the piston to shift thus to actuate the perforating gun. In a third such system, the Hyde patent shows a firing device utilizing a latch plunger exposed on both sides to submergence pressure until the packer is set, thus isolating the then existing submergence pressure on one side of the plunger. When the tester valve is opened, the pressure on the other side of the plunger is correspondingly reduced, causing it to shift and release a firing hammer.

SUMMARY

In accordance with one aspect of the present invention, an apparatus for actuating a device downhole in a borehole is provided. The apparatus includes a body; a port for admitting fluid pressure into the body; and means within the body in fluid pressure communication with the port for actuating the tool in response to (1) a first fluid pressure level communicated through the port in excess of the hydrostatic pressure level, followed by (2) a second fluid pressure level communicated through the port less than the first fluid pressure level. Since the apparatus is operated solely by fluid pressure, there is no need for the use of a device such as a detonating bar nor is there any need to use a wireline or to manipulate the tubing string. The apparatus is not limited to applications where a tester valve or similar device is to be used. Accordingly, the apparatus of the present invention may be utilized both in testing operations and in well completion operations. In addition, the present invention provides the ability to establish the pressure condition in the borehole with relative precision at the time of tool actuation. This is especially desirable where the apparatus is to be used to actuate a perforating gun and a certain underbalance is required at the time of perforation.

In accordance with a further aspect of the present invention, a perforating gun is suspended in a borehole on an end of a tubing string adjacent an interval of the borehole to be perforated. The gun is provided with a pressure actuated firing head which comprises a port for admitting fluid pressure into the firing head, and means within the firing head in fluid pressure communication with the port for actuating the perforating gun in response to (1) a first fluid pressure level communicated through the port in excess of hydrostatic pressure, followed by (2) a second fluid pressure level communicated through the port less than the first fluid pressure level.

In accordance with another aspect of the present invention, a method is provided of perforating an oil and/or gas well, which comprises the steps of increasing the fluid pressure in a portion of the well to thereby isolate a predetermined pressure condition in a perforating means downhole in the well, and then reducing the fluid pressure in the portion of the well such that the perforating means is actuated in response to the isolated predetermined pressure condition and the pressure reduction.

In accordance with yet another aspect of the present invention, a method of perforating an oil and/or gas well is provided which comprises the steps of increasing the fluid pressure in a portion of the well above a hydrostatic pressure condition to a first, elevated pressure condition therein, and then decreasing the fluid pressure in said portion of the well to a second pressure condition lower than the first pressure condition, such that a perforating means downhole in the well is actuated to perforate the well in response to the increase in fluid pressure followed by the decrease in fluid pressure in said portion.

BRIEF DESCRIPTION OF THE DRAWINGS

The present invention, as well as further objects and features thereof, will be understood more clearly and fully from the following description of certain preferred embodiments, when read with reference to the accompanying drawings, in which.

DETAILED DESCRIPTION OF CERTAIN PREFERRED EMBODIMENTS

Figure 1A:
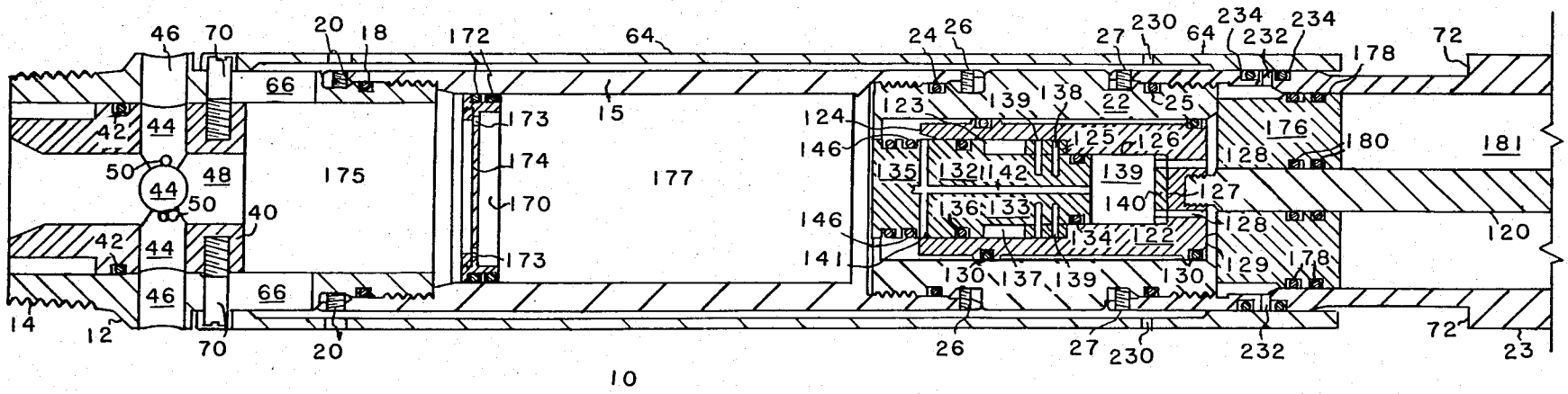
FIGS. 1A and 1B are partially cross-sectional views of a pressure actuated perforating gun firing head in accordance with one advantageous embodiment of the present invention.
Figure 1B:
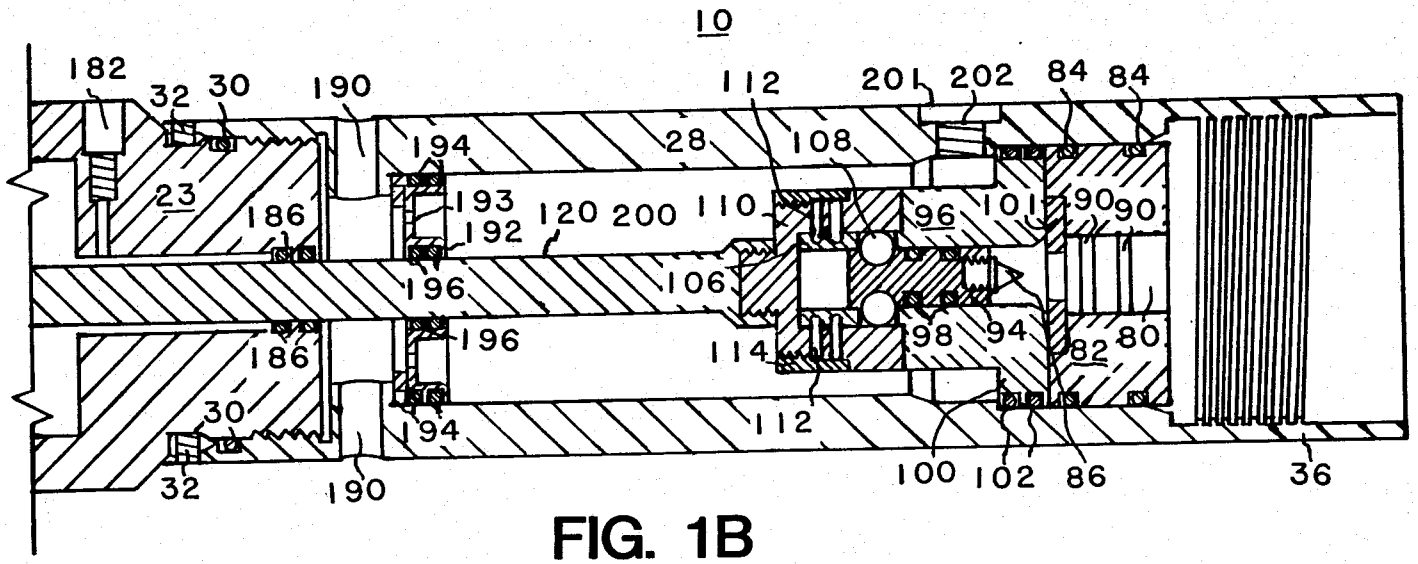
Figure 1C:
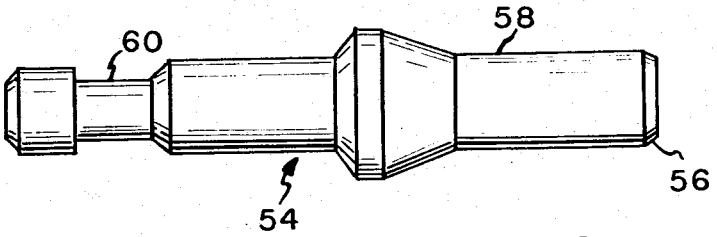
FIG. 1C is a full view of the disarm plug.

FIGS. 1A and 1B i11ustrate a fluid pressure actuated firing head for oil and/or gas well perforating guns, embodying one particularly advantageous application of the present invention. With reference particularly to FIG. 1A, a generally cylindrical disarm sub 12 is provided with a pin type coupling 14 at a first end of the firing head 10 and adapted to form a threaded coupling with another downhole tool or with a joint of tubing in a tubing string. An opposed end of the disarm sub 12 forms a threaded connection with a tubular member 15 at a first end thereof. An O-ring 18 provides a fluid-tight seal between the outer surface of sub 12 and the inner surface of tubular member 15. Two set screws 20 oppose decoupling of the sub 12 from the tubular member 15.

An opposed, second end of the tubular member 15 is threadedly coupled to a piston chamber sub 22 at a first end thereof. An O-ring 24 seals the outer surface of sub 22 to the inner surface of tubular member 15, while a further pair of set screws 26 prevent decoupling of tubular member 15 and sub 22. An intermediate sub 23 is threadedly coupled to sub 22 at a second end thereof. An O-ring 25 seals the outer surface of sub 22 to the inner surface of intermediate sub 23, while a pair of set screws 27 prevent decoupling of sub 22 and sub 23. With reference to FIG. 1B, an opposed, second end of sub 23 is threadedly coupled to a tubular housing 28 and an O-ring 30 seals the exterior surface of the sub 23 to the interior surface of the housing 28, while two additional set screws 32 prevent decoupling of the sub 22 from the housing 28. An opposed, second end of the housing 28 is provided with a box type coupling 36 adapted to form a fluid-tight connection with the housing of a perforating gun.

With reference again to FIG. 1A, a disarm piston 40 is slidably positioned within the disarm sub 12 initially adjacent the first or pin end 14 thereof and forming a fluid-tight seal against the inner surface of the sub 12 by means of an O-ring seal 42. Four transverse ports 44 are formed through the piston 40 and are initially aligned with corresponding ports 46 formed through the sides of the disarm sub 12. Disarm piston 40 is also provided with an axial center bore 48 extending therethrough and in communication with the ports 44 thereof, so that the exterior of the disarm sub 12 and of the firing head 10 is in fluid pressure communication with the interior of the disarm sub 12 and, initially, with the interior of the tool or tubing joint coupled to the firing head 10 at the pin end 14. A plurality of shear pins 50 maintain the initial position of the disarm piston 40 axially with respect to the disarm sub 12.

Also shown in FIG. 1A is a disarm plug 54 having a lower, generally cylindrically shaped portion 56 adapted to seat in the port 48 of the disarm piston 40 and to form a fluid-tight seal thereagainst by virtue of a chevron-type seal 58 provided in the lower portion 56. Disarm plug 54 is also provided with a fishing neck 60 which permits the plug 54 to be retrieved, if so desired.

A disarm sleeve 64 is slidably mounted on the exterior of the tubular member 15 and the disarm sub 12. The disarm sub 12 is provided with four axially extending slots 66 (only two of which are shown in FIG. 1A) extending therethrough adjacent a first end of the disarm sleeve 64. Four screws 70 (only two of which are shown in FIG. 1A) are threaded into and retained by the disarm piston 40 and extend radially outwardly therefrom through the slots 66 and into four circular bores formed in the disarm sleeve 64 adjacent its first end, such that a sliding movement of the piston 40 inwardly of the disarm sub 12 from the pin end 14 will cause the sleeve 64 to slide over the disarm sub 12 and the tubular member 15 to the extent that the slots 66 permit the screws 70 to travel axially therethrough. A shoulder 72 is formed in the intermediate sub 23 thus to prevent further axial movement of the sleeve 64 which might shear the screws 70 with a consequent loss of control over the position of the sleeve 64.

With reference to FIG. 1B, a detonation initiator 80 is received within a central bore of a retaining member 82 positioned within the housing 28 adjacent the box coupling 36 thereof, such that a threaded end of a perforating gun coupled thereto abuts a first extremity of the detonation initiator 80 and the retaining member 82, thus opposing movement thereof outwardly of the housing 28. Two O-ring seals 84 seal an outer cylindrical surface of the retaining member 82 against an inner surface of the housing 28.

The detonation initiator 80 is an impact type detonator adapted to provide a detonating output to the perforating guns when struck at an opposite extremity by a firing pin 86. A plurality of O-rings 90 seal the exterior of the detonation initiator 80 to the interior of the retaining member 82. The detonation initiator 80 may utilize, for example, a percussion primer of the type disclosed in U.S. patent application Ser. No. 587,344 entitled PRIMER MIX, PERCUSSION PRIMER AND METHOD OF INITIATING COMBUSTION filed Mar. 8, 1984, now U.S. Pat. No. 4,522,665, in the name of Donald N. Yates and assigned to the assignee of the present application, the entire disclosure of which is incorporated herein by reference. An exemplary primer mix includes 41% by weight titanium and 59% by weight potassium perchlorate compacted to a density of from 2.3 to 2.5 gm/cc by subjection to compaction pressure of from 15,000 to 50,000 psi.

The firing pin 86 is carried by a plunger 94 positioned slidably within a central bore of a plunger housing 96 abutting the retaining member 82. The exterior surface of the plunger 94 is sealed against the central bore of the housing 96 by a pair of O-ring seals 98. The plunger housing 96 is held between the retaining member 82 (at a first end of the housing 96) and a shoulder 100 of the housing 28, such that it is immovable with respect to the housing 28. An annularly shaped shock absorber 101 is retained between member 82 and housing 96 and serves to prevent damage to the plunger 94 upon firing. An outer surface of the housing 96 is sealed against an inner surface of the housing 28 by two O-ring seals 102. The plunger housing 96 has a reduced diameter neck portion 106 adjacent a second end thereof and having four circular bores radially therethrough (of which only two are shown in FIG. 1B) in which four steel balls 108 are captured between an annular indentation in the plunger 94 having a generally semi-circular configuration to conform with the shape of the balls 108, and a cup-shaped ball release 110 positioned over the neck portion 106 of the plunger housing 96 and releasably affixed thereto by a plurality of shear pins 112. The shear pins 112 are maintained within the ball release 110 by a generally cylindrical pin retainer 114 threadedly coupled over the ball release 110 and restraining the pins 112 from slipping outwardly of the neck 106 and ball release 110.

The ball release 110 is threadedly coupled to a rod 120 at a first end thereof. The rod 120 extends from the ball release 110 toward the pin end 14 axially through the housing 28, the intermediate sub 23 and the piston chamber sub 22 (FIG. 1A). A first piston 122 is threadedly coupled with the rod 120 at an opposed end thereof and is positioned within a central bore of piston chamber sub 22. The piston 122 forms a fluid-tight seal with the central bore of sub 22 by virtue of two O-rings 130.

Piston 122 has a first, relatively large diameter recess 123 extending from a first end 124 thereof towards the box end 36 of the firing head 10 and terminating at an inwardly extending shoulder 125 of piston 122. A second, relatively smaller diameter recess 126 within piston 122 extends from shoulder 125 towards the box end 36 of firing head 10. Second recess 126 terminates at an inner wall 127 of piston 122. A plurality of fluid passageways 128 extend from the inner wall 127 of piston 122 through an outer wall 129 thereof closest the box end 36.

A second piston 132 has a first, relatively small diameter portion 133 extending partially into recess 126 of piston 122 and having an outer wall fitting closely with recess 126 of piston 122. The outer surface of portion 133 is sealed against recess 126 by an O-ring 134. Portion 133 extends from recess 126 towards the pin end 14 of firing head 10 and terminates at a second, relatively larger diameter portion 135 of piston 132 having an outer surface fitting closely against the recess 123 of piston 122. The second portion 135 of piston 132 is sealed against the recess 123 of piston 122 by an O-ring 136. An annular air chamber 137 is defined between the outer surface of portion 133 and the wall of the recess 123 of piston 122.

A shear pin ring 138 abuts the shoulder 125 of piston 122 and is releasably secured to piston 132 by a plurality of shear pins 139. Accordingly, the shear pins 139 and the shear pin ring 138 releasably secure the piston 132 against movement inwardly of piston 122 until sufficient force is exerted against the pins 139 to shear them. A disc shaped piston stop 140 abuts wall 127 of piston 122 and is provided with a plurality of fluid passageways therethrough to ensure fluid communication between the interior of recess 126 and the passageways 128. The piston stop 140 serves to absorb the shock of impact between the portion 133 of piston 132 and the wall 127 of piston 122, as will be described in greater detail below.

A radial port 141 extends through the larger diameter portion 135 of piston 132 and is in fluid communication with the volume 177 bounded by the interior of the tubular member 15. A longitudinal port 142 in fluid communication with the port 141 extends through the relatively smaller diameter portion 133 of piston 132 and is in fluid communication with the volume defined between the portion 133, the recess 126 of piston 122 and the stop 140. Accordingly, while the piston 132 is maintained in the position shown in FIG. 1A, there is fluid communication between the volume 177 and the exterior of the piston 122, on the one hand, and the fluid volume adjacent the side 129 of the piston 122. This volume is filled with a clean fluid such as oil or diesel fuel, so that the narrow passages extending through the stop 140 and the passages 128 in piston 122 do not become clogged with particulate matter present in well fluids on the exterior of firing head 10. Two O-rings 146 are positioned within annular recesses in the exterior of portion 135 of piston 132 and positioned to seal the port 141 from the volume 177 within the tubular member 15 when the piston 132 has been fully extended into the piston 122.

An axial extremity of the volume within tubular member 15 and closest to the pin end 14 is defined by a floating piston 170 slidably disposed within the member 15 and sealed thereto by two O-ring seals 172. The opposite side of the floating piston 170 is exposed to well fluids admitted through the ports 46 in the disarm sub 12 and the ports 44 in the piston 40, and is also in communication with the interior of the tubing or other tool coupled at the pin end 14 through the port 48 in the piston 40. A plurality of ports 173 extending through piston 170 are closed by a frangible shim 174 held within piston 170. The use of shim 174 prevents the build up of a pressure differential between the volume 177 within tubular member 15 and piston 170, and the exterior of the firing head 10. The volume on the side of piston 170 opposite volume 177 and within the disarm sub 12 is designated 175.

An additional floating piston 176 is provided on the opposite side of the first piston 122 and forms a slidable seal against a relatively large diameter, inner surface of the intermediate sub 23 by virtue of two O-ring seals 178 and forms a slidable seal against the rod 120 by virtue of two additional O-ring seals 180. The interior surface of the sub 23 and the piston 176 enclose a chamber 181 filled with nitrogen through a check valve 182 (FIG. 1B) providing fluid communication from the exterior of the sub 23 to the nitrogen chamber 181. An extremity of the intermediate sub 23 opposite the piston 122 has a reduced diameter axial bore which forms a fluid-tight seal against the rod 120 by virtue of two further O-rings seals 186 (FIG. 1B).

Adjacent this extremity of intermediate sub 23 are formed four radial ports 190 (only two of which are shown in FIG. 1B) through the housing 28 admitting fluid pressure on the exterior of firing head 10 therethrough into the chamber defined between the seals 186 and an additional floating piston 192 sealed at its outer surface against the interior surface of the housing 128 by additional O-ring seals 194 and sealed against the rod 120 by still further O-ring seals 196 between the floating piston 192 and the rod 120. The volume 200 between the interior wall of the housing 28, the rod 120, the piston 192 and the retaining member 96 is filled with a clean fluid, such as oil or diesel fuel. Piston 192 has a plurality of ports therethrough closed by a shim 193 held within piston 192. Like shim 174 of piston 170, shim 193 prevents build up of a pressure differential between the volume 200 and the exterior of the firing head 10. A rupture disc retainer 201 having a port therethrough closed by a rupturable disc 202 is threadedly received in the outer wall of housing 28, so that the disc 202 is exposed to pressure in the volume 200 on its interior side and exposed to borehole pressure on its exterior side. Disc 202 is selected so that it spontaneously ruptures when the pressure differeneital across it exceeds 500 psi. Accordingly, a means is provided for releasing pressure which might be trapped in volume 200 when the firing head 10 is retrieved from the borehole.

Figure 2:
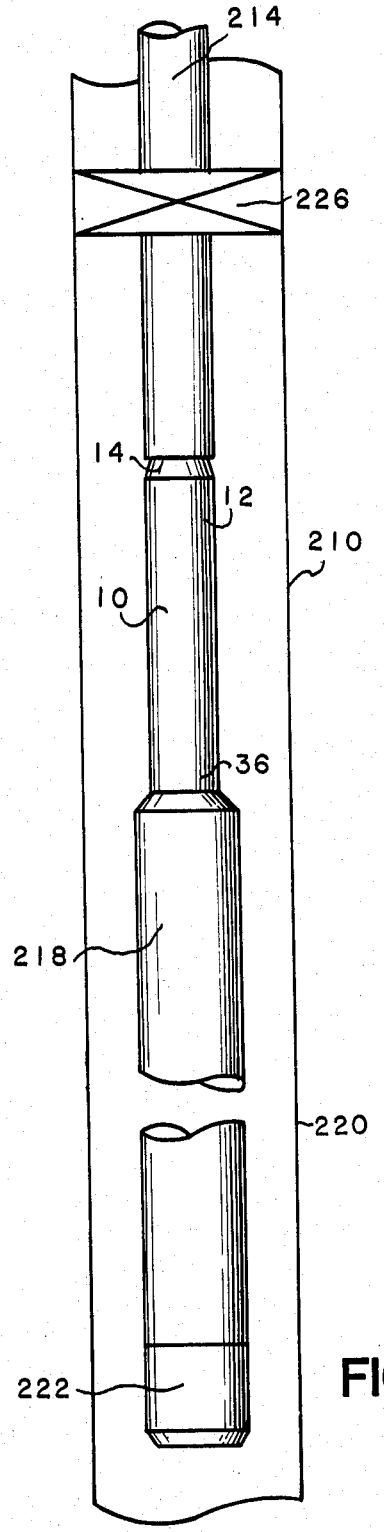
FIG. 2 is a partially cross-sectional view of a borehole in the earth wherein tubing conveyed perforating guns have been positioned to perforate the casing at a desired depth and utilizing the firing head of FIGS. 1A and 1B.

One possible downhole arrangement utilizing the firing head of FIGS. of 1A and 1B is shown in FIG. 2 which illustrates a portion of a borehole formed in the earth and lined with a casing 210. A tubing string 214 is coupled at its lower end to the pin end 14 of disarm sub 12 of the firing head 10. The box end 36 of the firing head 10 is threadedly coupled to a string of perforating guns 218 extending downwardly therefrom and positioned opposite a portion 220 of the casing 210 which it is desired to perforate with the guns 218. Coupled to the guns at their lowermost extremity is a shot detection device 222 which is operative to provide a signal transmitted upwardly through the tubing string 214 to the wellhead after a time delay provided by a combustive time delay element incorporated within the shot detection device 222. Shot detection device 222 may be, for example, that disclosed in U.S. patent application Ser. No. 505,911 filed Jun. 20, 1983, now abandoned, in the names of Edward A. Colle, Jr., et al. entitled METHOD AND APPARATUS FOR DETECTING FIRING OF PERFORATING GUN.

Once the guns 218 have been positioned adjacent the desired location 220, a packer 226 carried by the tubing string 214 and positioned above the firing head 10 is set to isolate the casing annulus therebelow from the annulus above the packer. In the particular arrangement of FIG. 2, the firing head 10 is actuated to fire the perforating guns 218 through a two-step procedure, wherein (1) tubing pressure which is applied through the port 48 of disarm piston 12 is increased above a first predetermined value in excess of hydrostatic pressure, thus to arm the firing head 10, and (2) the firing head is thereafter fired by reducing the tubing pressure to a second pressure level. With reference to FIGS. 1A and 1B, tubing pressure is applied through the port 48 through pin end 14, as indicated above. The pressure in volume 175 is thus increased accordingly. This pressure is applied substantially undiminished through the floating piston 170 to the volume of clear fluid 177 on its opposite side. Since at this time a fluid pressure path exists from the volume 177 through the ports 141, 142 and 128 to the floating piston 176, the nitrogen gas previously stored in volume 181 is in equilibrium with the pressure in volumes 177 and 175 through the floating piston 176.

As the pressure in the volume 177 is thus increased, the force across the piston 132 produced by fluid pressure against the extremity thereof adjacent volume 177 and the surface thereof defining the first extremity of the air chamber between the portion 133 of the piston 132 and the recess 123 correspondingly increases, until the pins 139 fail and the piston 132 slides within piston 122, abutting the piston stop 140. O-rings 146 thus form a fluid-tight seal between portion 135 of piston 132 and recess 123 of piston 122, sealing off port 141 from volume 177. It will be seen that fluid pressure within the nitrogen chamber 181, as well as fluid pressure exerted against wall 129 of the piston 122 opposite the pin end 14 of firing head 10 is thus trapped. It will be appreciated that it is not necessary to know the hydrostatic pressure precisely when applying tubing pressure in this manner to arm the firing head 10, since it is only necessary to increase tubing pressure sufficiently so that it is reasonably certain that the shear pins 139 have broken. It will also be seen that if, for any reason, the firing head does not arm in this manner, the procedure may be repeated with relative ease and expeditiously. The force of the piston 132 striking the wall 127 is largely absorbed by the piston stop 140. This helps prevent damage to the apparatus, and also helps prevent premature firing of the firing head 10 by minimizing the shock experienced by shear pins 112 when piston 132 impacts the stop 140.

With reference again to FIG. 1B, it is seen that lower annulus pressure is communicated within the housing 28 through the ports 190 and thus is applied through the floating piston 192 to the clean fluid in the volume 200. The fluid pressure in the volume 200 is applied to the surface of the plunger 94 opposite the firing pin 86, which is restrained against striking the detonation initiator 80 so long as the balls 108 are retained within the neck 106 of the housing 96. As the tubing pressure is reduced subsequent to the increase which armed the firing head as described above, the force across the piston 122 produced by the pressure against its wall 129 opposite the pin end 14 and the reduced pressure on the opposing side of the piston 122 is coupled through the rod 120 to the release member 110. When this force becomes sufficiently great, the shear pins 112 fail so that the piston 122 is driven towards the pin end 14, thus pulling the ball release 110 off the neck 106 and freeing the balls 108 holding the plunger 94. The firing pin 86 is then driven into the initiator 80 by hydrostatic pressure applied to the opposite side of plunger 94, so that initiator 80 yields a detonating output at its opposed end to fire the guns 218.

It will be appreciated that the firing head 10 may be arranged for arming and firing through a wide range of fluid pressure values, determined from time to time simply through the proper selection of the shear pins 112 and 139. Accordingly, it is possible to provide a firing head, or other explosion initiator, which is to be fired either at, above or below hydrostatic pressure. The firing head of the instant embodiment is particularly useful where it is desired to perforate the casing of a borehole with an underbalanced condition and requiring only the adjustment of tubing pressure to carry out the firing sequence.

In one exemplary method, the guns 218 and firing head 10 are run into the well on tubing 214 and, prior to setting the packer 226, a light fluid is pumped down the tubing to circulate drilling mud out of the tubing string 214 through the ports 46 of disarm sub 12. If a sufficient underbalance is thereby achieved, the packer 226 is then set. If it is desired to reduce the pressure opposite the interval 220 at the time of perforation to an even lower value, the fluid in the tubing 214 can be circulated out by pumping nitrogen down the tubing and then setting the packer 226, or by setting the packer and then swabbing out a desired amount of fluid from the tubing 214. If there is then a full column of light fluid in the tubing 214, pump pressure may be increased so that the pressure applied through the port 48 of the firing head 10 is increased sufficiently to arm the firing head. If there is not a full column of fluid in the tubing 214, nitrogen may be pumped down on top of a partial column of fluid to achieve the necessary arming pressure. Thereafter, either pump pressure is reduced or nitrogen is bled off until the predetermined firing pressure is achieved, whereupon the guns 218 are fired by the firing head 10.

It will be seen that it is unnecessary to manipulate the tubing string in order to fire the firing head 10. This is especially advantageous in offshore operations where tubing string manipulation is sometimes very difficult. It is likewise unnecessary to drop a detonating bar, which is advantageous in situations where particles from the drilling mud may have settled out upon an impact responsive firing head or where the borehole is highly deviated. Moreover, the explosion initiator of the present invention is not limited to applications where a tester valve is included in the string. It will be seen also that it is necessary only to manipulate the fluid pressure in one portion of the borehole (in this particular embodiment, in the tubing). Accordingly, it is not necessary to manipulate both annulus pressure and tubing pressure, as in other systems.

When it is desired to disarm the firing head 10, this can be achieved principally through the provision of disarming means responsive to an increase in the pressure applied across the disarm piston 40, for example, applied through the tubing, causing the piston 40 to shift and effectively prevent subsequent actuation of the firing head. With reference to FIG. 1A, the disarm sequence for the particular embodiment of FIGS. 1A and 1B involves first, dropping the disarm plug 54 (FIG. 1A) downwardly through the tubing to seat in the port 48 of the disarm piston 40. The chevron seals 58 in the disarm plug 54 form a fluid-tight seal against the walls of the port 48, so that tubing pressure may be increased to produce a pressure differential across the disarm piston 40. When this pressure differential exceeds a predetermined amount, the shear pins 50 holding the disarm piston immovable with respect to the disarm sub 12, fail so that the piston 40 shifts inwardly of the pin end 14. Since the disarm sleeve 64 is coupled to the piston through the screws 70, the disarm sleeve likewise shifts downwardly away from the pin end 14.

Eight ports 230 (of which only two are shown in FIG. 1A) are provided through the disarm sleeve 64 and four additional ports 232 are provided through the intermediate sub 23 communicating the exterior thereof with the fluid volume on the side of piston 122 opposite the pin end 14. So long as the disarm sleeve 64 is in the position shown in FIG. 1A, the ports 232 are sealed against fluid communication with exterior of the firing head 10 by virtue of two O-ring seals 234 provided on opposite sides of the ports 232 and sealing the outer surface of the sub 23 against the interior of the disarm sleeve 64. When, however, the disarm sleeve 64 has been shifted away from the pin end 14 through the motion of the piston 40, the ports 230 in the sleeve 64 are aligned with the ports 232 through the sub 23, so that the fluid volume on the side of the piston 122 opposite the pin end 14 is thereby brought into fluid pressure communication with the exterior of the firing head 10. At the same time, the fluid pressure in the volume 175 is maintained in communication with the pressure on the exterior of the firing head 10 through the ports 44 in the piston 40 and the slots 66 in the disarm sub 12. As noted above, the equalizing piston 170 maintains the pressure in the volume 177 equal to that in the volume 175. Accordingly, the pressure across the piston 122 is thereby equalized, so that if the firing head has not yet fired, it is then disabled from firing. When the piston 40 shifts due to the application of pressure to disarm the firing head, the seal 42 on piston 40 slides past ports 46. This communicates the exterior of the firing head 10 with the interior of the tubing. Accordingly, when this happens, a drop in tubing pressure occurs which is detectable at the surface. It is thus possible to determine positively that the firing head 10 has been disarmed. This is particularly advantageous in operations, such as drill stem testing, where it is the normal practice to retrieve the tool string from the well when the operation is completed, since the perforating guns may be brought to the surface with the foreknowledge that the firing head is disarmed.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

What is claimed is

1. An apparatus for actuating a perforating device downhole in a borehole extending from the surface of the earth and containing fluid therein, said apparatus attached to an end of a tubing string extending from the surface of the earth and having said perforating device attached to the other end thereof, said apparatus comprising:

a body;

a port for admitting fluid pressure into the body;

means within the body in fluid pressure communication with the port for actuating the device in response to (1) a fluid pressure level greater than a first predetermined fluid pressure level communicated through the port, the first predetermined fluid pressure level communicated through the port being in excess of the hydrostatic pressure level of said fluid in said borehole, followed by (2) a second fluid pressure level communicated through the port, the second fluid pressure level communicated through the port being less than the the first predetermined fluid pressure level; and disarming means for rendering the actuating means inoperable through the application of fluid pressure through said tubing string to the disarming means thereby preventing the actuation of said perforating device while allowing retention of said perforating device on said tubing string to allow the removal of said perforating device with said tubing string when said tubing string is removed from said borehole, the disarming means including:

a piston means slidably contained within said apparatus; and a plug means engageable with the piston means to prevent fluid flow in said conduit string past the piston means to allow actuation of the disarming means by the application of fluid pressure through said tubing string whereby the plug means is inserted into and moves through said tubing string when it is desired to disarm the means within the body for actuating the device by engaging the piston means permitting the disarming means to be subjected to the application of fluid pressure through said tubing string thereby preventing the actuation of said perforating device by said apparatus while allowing retention of said perforating device on said tubing string to allow the removal of said perforating device with said tubing string when said tubing string is removed from said borehole.

2. The apparatus of claim 1, wherein the body is adapted to be coupled to said tubing string in the borehole and the port is positioned on the body such that the port is in fluid pressure communication with the interior of said tubing string when the body is coupled thereto.

3. The apparatus of claim 2, wherein the body is adapted to be coupled to a perforating gun and the means for actuating the device is adapted to actuate the perforating gun.

4. The apparatus of claim 1, wherein the body is adapted to be coupled to a perforating gun and the means for actuating the device is adapted to actuate the perforating gun.

5. The apparatus of claim 1, wherein the means for actuating the device comprises:

means for storing the fluid pressure level which is greater than the first or the second fluid pressure level in response to the application of the fluid pressure level through the port in excess of the first predetermined pressure level; and means for actuating the device in response to the stored pressure level and the application of the second fluid pressure level through the port.

6. The apparatus of claim 5, wherein the storing means comprises:

a fluid pressure chamber in the body;

a fluid pressure passageway communicating fluid pressure from the port to the fluid pressure chamber; and means for closing the fluid pressure passageway in response to the communication through the port of a fluid pressure level in excess of the first predetermined fluid pressure level.

7. The apparatus of claim 1, wherein the body comprises a tubular member having a threaded coupling at a first end thereof adapted to make a threaded connection with a tubing string and the port is formed in the tubular member at the first end thereof to communicate fluid pressure between the interior of the tubular member and the interior of the tubing string; and wherein the actuating means comprises a fluid pressure chamber within the tubular body;

a fluid pressure passageway formed within the tubular body for communicating fluid pressure from the port to the fluid pressure chamber;

means for closing the fluid pressure passageway in response to the communication through the port of a fluid pressure in excess of the first predetermined fluid pressure level to store a fluid pressure level in the fluid pressure chamber; and means for actuating the device in response to the stored fluid pressure level and the application of the second fluid pressure level through the port.

8. The apparatus of claim 7, wherein the means for closing the fluid pressure passageway comprises a second piston disposed in a first piston disposed, in turn, in a piston chamber sub connected to the tubular body and exposed at a first surface to fluid pressure in the fluid pressure passageway and exposed at a second, opposed surface to a second predetermined fluid pressure, the second piston means being operative to slide within the tubular body thus to block the fluid pressure passageway when the fluid pressure therein exceeds or equals the first predetermined fluid pressure level.

9. In a borehole containing fluid therein having a perforating gun suspended on an end of a tubing string adjacent an interval of the borehole to be perforated, the gun having a pressure actuated firing head comprising:

a port for admitting fluid pressure into the firing head, means within the firing head in fluid pressure communication with the port for actuating the perforating gun in response to (1) a first fluid pressure level greater than a first predetermined fluid pressure level communicated through the port, the first predetermined fluid pressure level communicated through the port being in excess of the hydrostatic pressure level of the fluid in the borehole, followed by (2) a second fluid pressure level communicated through the port, the second fluid pressure level communicated through the port being less than the first predetermined pressure level; and disarming means for rendering the actuating means inoperative through the applicaton of fluid pressure through the tubing string to the disarming means thereby preventing the actuation while allowing retention of said perforating gun on said tubing string to allow the removal of said perforating gun with said tubing string when said tubing string is removed from said borehole, the disarming means including:

a piston slidably contained within said pressure actuated firing head; and a tubing string conveyed plug engageable with the piston to prevent fluid flow in the tubing string past the piston to allow actuation of the disarming means by the application of fluid pressure through the conduit string whereby the tubing conveyed plug is inserted into and moves through said tubing string when it is desired to disarm the means within the firing head for actuating the perforating gun by engaging the piston permitting the disarming means to be subjected to the application of fluid pressure through said tubing string thereby preventing the actuation of said perforating gun by said pressure actuated firing head while allowing retention of said perforating gun on said tubing string to allow the removal of said perforating gun with said tubing string when said tubing string is removed from said borehole.

10. The apparatus of claim 9, wherein the port is in fluid pressure communication with the interior of the tubing string.

11. The apparatus of claim 9, wherein the port is in fluid pressure communication with the borehole annulus defined between the exterior of the string and the wall of the borehole.

12. The apparatus of claim 9, wherein the firing head is disposed below a packer means dividing the annulus between the tubing and the walls of the borehole into an upper annulus and a lower annulus.

13. The apparatus of claim 12, wherein the firing head is disposed beneath the perforating gun and the port is exposed to fluid pressure in the lower annulus.

* * * * *